United States Patent [19]

Cary

[11] Patent Number: 4,542,553

[45] Date of Patent: Sep. 24, 1985

[54] DEVICE FOR REMOVING DEBRIS FROM GUTTERS

[76] Inventor: Allan P. Cary, 2673 Bretby, Troy, Mich. 48098

[21] Appl. No.: 384,918

[22] Filed: Jun. 4, 1982

[51] Int. Cl.[4] ..... E04D 13/00

[52] U.S. Cl. ..... 15/236 R; 15/143 R; 294/19 R

[58] Field of Search ..... 15/236 R, 143 R, 145, 15/242, 144 R, 111; 294/9–11, 19 R; 56/400.01, DIG. 8; 30/169; D7/102, 104, 393; D32/40–42, 46, 49–52; 126/16, 242, 243

[56] References Cited

U.S. PATENT DOCUMENTS

| | | | |
|---|---|---|---|
| 767,648 | 8/1904 | Korjibsky | 126/242 |
| 1,600,110 | 9/1926 | Griffin | 126/242 |
| 2,753,579 | 7/1956 | Kussmann | 15/145 |
| 3,626,542 | 12/1971 | Despain et al. | 15/236 |
| 4,194,780 | 3/1980 | Dilley | 15/236 R X |

FOREIGN PATENT DOCUMENTS

| | | | |
|---|---|---|---|
| 232247 | 7/1910 | Fed. Rep. of Germany | 15/236 R |
| 8207 | 4/1844 | France | 15/242 |

*Primary Examiner*—Edward L. Roberts

*Attorney, Agent, or Firm*—Irving M. Weiner; Pamela S. Burt

[57] ABSTRACT

A tool for cleaning gutters which comprise a singular rod-like member to which is attached a plate adjacent one end and a handle adjacent the other, and which is so configured that the plate can be scrapped along an eaves trough by a user without scrapping of the finger and which is of light weight and can be safely used by one positioned on a ladder.

5 Claims, 5 Drawing Figures

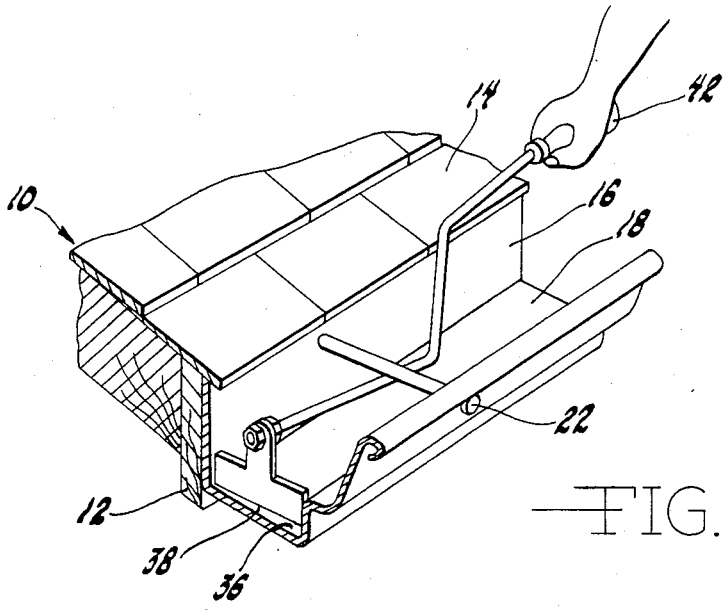
FIG. 1
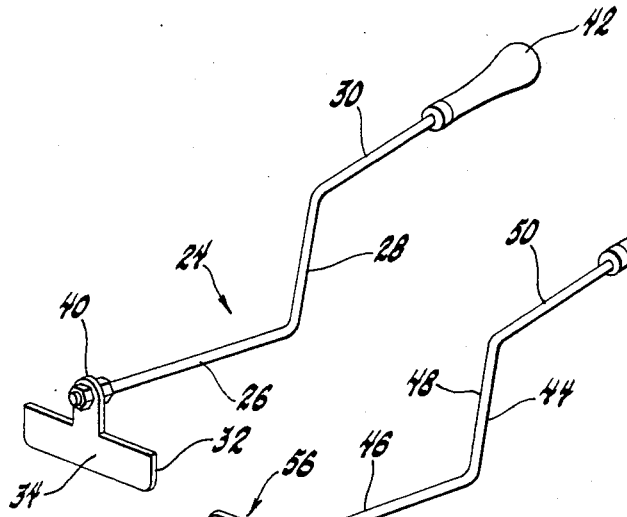
FIG. 2
FIG. 3
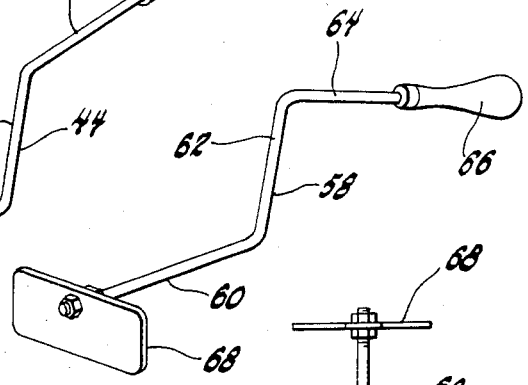
FIG. 4
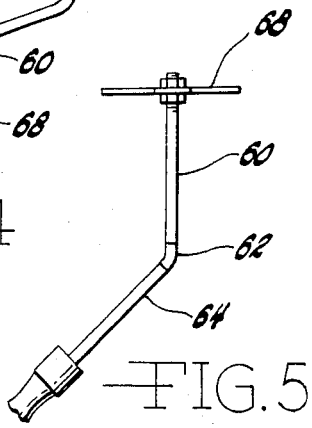
FIG. 5

DEVICE FOR REMOVING DEBRIS FROM GUTTERS

The present invention relates generally to a tool for cleaning gutters of leaves, roofing material granules, dirt and other accumulations.

BACKGROUND OF THE INVENTION

It is at least an annual chore in most locations where there are trees of any size to remove the leaves and other debris that accumulates in gutters of the type commonly used on residences. This material must be removed in order to permit the proper drainage of the water received from the adjacent roof in order to prevent backflow into the adjacent house. Further, with many gutters, particularly steel gutters, it is desirable that the drainage be free or unblocked in order to eliminate rusting.

The aforesaid gutters are normally maintained in position by means of gutter spikes or clips which are secured to the roof. In either event, these clips and spikes interfere with the cleaning process. Various tools are used by home owners in this generally disagreeable task, such as trowels, spatulas and the like.

In order to successfully clear the gutters it is usually necessary to either approach the gutter from the roof, or to approach it from a ladder. One must get his tool over the top of the gutter and into it in order to successfully reach the debris and be sure that the bottom of the gutter is clear. Further, it is desirable that the user view the tool as it is moved along the trough. Some attempts have been made nonetheless to provide tools which can be used by the home owner while he is on the ground adjacent the side of the home. These tools include elongated links of tubes or the like and require operation of the tool from the end of a tool handle while preventing observation of the gutter itself. Such tools are cumbersome because of their length and it is unlikely that they are in extensive use.

One of the heretofore proposed solutions to the above-described gutter cleaning problem is that disclosed in Despain et al, U.S. Pat. No. 3,626,542. As disclosed in this patent the gutter cleaning tool comprises a handle which is of adequate length to reach above the gutter when held at its lower end by a person standing on the ground. At its upper end the handle is configured so as to provide a downwardly extending section which terminates in a tool holding portion. A tool suitable for use in cleaning the gutter is attached to this downwardly extending section. The tool includes a series of tines which can be aligned substantially parallel to the longitudinal axis of the gutter. The tines have a step-like configuration and are designed so that they can be moved under a gutter spike.

U.S. Pat. No. 3,858,267 granted to Swannie discloses another form of tool for cleaning gutters while the user is walking along the ground beneath the gutters. In this instance there is provided an elongated handle to which there is pivotally attached at its upper end a plate-like blade member which is configured to the general shape of the gutter trough. According to the patent it is intended that the blade can be pushed along the guttering.

Dilley, U.S. Pat. No. 4,194,780 shows yet another gutter cleaning tool. In this instance there is a longitudinally extending handle at one end of which there is attached a set of paddles on which are mounted scraping members. There are a pair of these paddles and scraping members mounted on an arm which extends perpendicularly to the handle. The arrangement of paddles and scrapping members on the Dilley device is such that the user can push or pull the debris along the gutter when the user is substantially at the level of the guttering.

The present invention overcomes some of the deficiencies and problems attendant devices known in the art, and provides a tool which is more practical for the intended purpose.

SUMMARY OF THE INVENTION

The present invention provides a simple, inexpensive and easy to use gutter cleaning tool. The tool comprises a minimum number of parts and can be used by an owner of a home, for example, with great ease. It can be readily handled while on a ladder, is light in weight, is not cumbersome, and is so configured that it can be used without entraining ones hands in the debris, and without scraping of knuckles or palms or arms along the guttering or the adjacent roof. The tool is not elongated to the extent that it would be difficult to use, yet it is of such a nature both as to configuration, size and weight that it can be readily carried up and down a ladder, held while on a ladder, and used without endangering the user. Yet, on the other hand, the tool is very effective and reliable.

An important feature is that the tool can be used by simply pressing along in the guttering so as to scrape the debris along ahead of it. On the other hand, from time to time the tool can be manipulated so as to facilitate removal of the material from the guttering and tossing of the material to one side.

According to the invention there is provided a gutter cleaning tool which embodies a rod-like member having a handle at one end and a blade attached to the opposite end. The blade presents a substantially flat face perpendicularly of the rod. The rod has a first section extending rearwardly from the plate, and substantially perpendicularly to the flat face of the plate. The rod further comprises a second section which extends upwardly vertically from the first section, and a third section extending substantially in a plane parallel to the horizontal plane of the first section and substantially normal to the flat face of the plate.

According to the invention, the second section is preferably of a length at least equal to about one-half the length of the first section. In addition, and according to one aspect of the invention, the third section can extend at an acute angle with respect to the vertical plane containing the first section, which plane extends substantially perpendicularly to the blade.

Further, according to the invention there is provided a blade on the end of an extended rod which is conformed to the shape of the trough to be cleaned, and presents a relatively flat plate-like face by means of which the gutter cannot only be swept of the leaves, but also the debris that may have accumulated, such as dirt and granules from composite roofing, can be easily moved and eventually removed from the trough.

Further, according to the invention, there is provided a pushing and pulling tool which can move under clips or gutter spikes. According to the invention the tool can be moved for a substantial distance under such an encumbrance, facilitating the movement of all the debris and its removal.

The invention further contemplates particularly in one of its forms a tool wherein the user's hand will be a distinct distance from the gutter and adjacent roof when the tool is in use.

BRIEF DESCRIPTION OF THE DRAWINGS

FIG. 1 is a perspective view showing a roof with a gutter along its eaves, and a tool constructed in accordance with the invention being placed into position for use.

FIG. 2 is a perspective view of the tool of FIG. 1.

FIG. 3 is a perspective view of a second form of the invention.

FIG. 4 is a perspective view of yet another form of the invention.

FIG. 5 is a fragmentary top plan view of the form shown in FIG. 4.

DETAILED DESCRIPTION OF PREFERRED EMBODIMENTS

FIG. 1 shows a typical roofing construction wherein the roof 10 terminates in a fascia board 12 which is overlapped by the outermost row of shingles 14.

The gutter or eaves trough has a vertically extending plate 16, a horizontally extending plate 18, and a more decoratively formed front plate 20 which cooperates with the lower plate and rear plate in forming a trough. Plate 20, in addition to serving as a means of enhancing the outward appearance of the gutter, also serves to stiffen the gutter due to its form.

A series of spikes 22 are driven through the upper lip of the front plate, through the rear plate and into the fascia board 12 in order to affix the guttering to the structure of the house. In some instances straps are used instead of the spikes.

A tool constructed according to the invention for use in cleaning debris from a gutter comprises a rod-like member 24, as shown in FIG. 2. The rod-like member is formed in three sections, a front or forward section 26, which is the left end section as viewed in FIG. 2, a second substantially vertically extending section 28, and a rear third section 30, which projects rearwardly from the central or second section 28, and substantially is substantially parallel to the first mentioned section 26, and parallel to the horizontal plane which would contain the section 26 when it is horizontally exposed. As shown in FIG. 2 however, the third section 30 extends at an acute angle upwardly with respect to the front section 26. The second, vertically extending section 28 is of a length to place the third section just above the gutter and above the nearby shingles when the tool is in use. In the form shown in FIG. 2, the second section is shorter in length than either the first section or the third section, and is approximately ½ the length of the first section.

The third section 30 is still further above the roofing and gutter due to its angular relation with respect to the front section 26. A blade 32, which is in the form of a substantially flat plate member is attached to the forward end of forward section 26. As shown in FIG. 2, the blade comprises a member which provides a flat face 34 extending transversely of and downwardly from forward section 26. As illustrated in FIG. 1, this plate is configured so as to closely fit in the bottom of the trough 36. As shown in FIG. 2, the blade 32 comprises a lower section 38 above which there projects a central section 40. The latter is provided with an opening for receiving the rod 26. In the form shown, a pair of nuts can be used to affix the plate to the rod. On the other hand, welding and/or staking and/or press fit can be employed to facilitate fastening the blade to the rod-like member. While the rod-like member is shown to be a solid rod, it is obvious that tubing could be employed.

The overall distance between the top of the central section 40 and the bottom of the lower section 38 is such that the tool can be passed under the typical spike 22 as shown in FIG. 1. Furthermore, the dimensioning of the blade 32 is such that a slight clearance will exist between the blade and the sides of the trough. As apparent from FIG. 1, the tool can be moved along the gutter so as to push or pull the material before it. Furthermore, at selected intervals the tool can be used as a shovel to remove the debris from the gutter and toss it over the side. The tool is provided with a handle 42 attached to its rearward, third section 30 in a known manner. As shown in FIG. 1, when the tool is inserted in the trough, the user's hand will be spaced a sufficient distance above both the gutter and the shingles so that his fingers and/or glove if used will not be scraped in using the tool.

FIG. 3 shows a second form of the invention wherein the rod-like member 40 has a forward section 46, a central section 48, and a rearward section 50, as well as a handle 52, all formed substantially in the same manner as shown in the form of the device illustrated in FIG. 2. In this case however, the blade 54 is in the form of a parallelepiped with the forward end of section 46 projecting through a suitable opening adjacent the uppermost edge of the blade 54, as shown at 56. Otherwise, the blade is in the same general form as shown in FIG. 2.

FIGS. 4 and 5 show yet another form of the invention. In this instance the rod-like member 58 also has a forward section 60 and a central upwardly extending section 62, coupled to a rearward section 64. As shown in FIGS. 4 and 5 however, in this instance the rearward section 64 extends at an acute angle with respect to the vertical plane containing the forward and central sections 60 and 62 respectively. As shown in FIGS. 4 and 5, this causes the handle 66 to be offset to the side of the trough when the device is positioned as shown in FIG. 1. The form shown would be most suitable for a right-handed person. For a left-handed person the offset of the upper section 64 can be to the opposite side to that shown in FIGS. 4 and 5. The purpose of this offset, with respect to the vertical plane containing the forward section 60 and the central section 62, is to ensure that the hand of the operator is even more distant from the roof shingles. The blade 68 in the form shown in FIGS. 4 and 5 is the same as that shown in FIG. 3.

From the foregoing it will be seen that I have provided a unique tool for cleaning gutters which is of simple construction, can easily be used by one positioned on a ladder or on a roof, and comprises a minimum number of parts. The tool can be used readily by any householder and is so designed that the scraping and cleaning of leaves, etc. can be easily achieved without scrapping of fingers, elbows or the like.

While I have shown the tools comprising blades such as 32 fastened to a rod at one end with a handle 42 fastened to the rod at the opposite end, it is within the scope of my invention to form the tool in one piece using plastic material. This would eliminate the need for fastening means, reduce the cost, and provide a more attractive unit. Also, the likelihood of separation of the components in service would be reduced.

Although there have been described what are at present considered to be the preferred embodiments of the invention, it will be understood that various modifications may be made therein without departing from the spirit or essential characteristics thereof. The present embodiments are therefore to be considered in all respects as illustrative, and not restrictive. The scope of the invention is indicated by the appended claims rather than by the foregoing description.

I claim:

1. A gutter cleaning tool comprising:

a rod-like member having a handle at a rear end thereof;

a blade attached to a forward end of said rod-like member, said blade presenting a substantially flat face;

said rod-like member having a substantially straight first section extending rearwardly from said blade substantially perpendicularly to said flat face of said blade;

said blade extending downwardly from said first section a distance which is less than the distance between a lower plate of said gutter and a gutter support member extending transversely across an upper inner portion of said gutter;

said first section of said rod-like member being disposed in its entirety in said gutter beneath said transversely-extending gutter support member when said tool is in use with said blade disposed in said gutter;

said rod-like member having a substantially straight second section extending upwardly from said first section;

said rod-like member further having a substantially straight third section extending rearwardly from said second section with respect to said first section and being positioned a distance above said first section such that said third section is disposed just above said gutter when said tool is in use with said blade disposed in said gutter;

said handle being provided at a rear end of said third section;

said second section being substantially shorter in length than either said first section or said third section;

said second section being of a length approximately equal to one-half the length of said first section; and said third section extendng at an acute angle with respect to a vertical plane containing said first section.

2. The gutter cleaning tool of claim 1, wherein:

said third section extends at an acute angle of approximately 45° with respect to the vertical plane containing said first and said second sections.

3. A gutter cleaning tool comprising:

a rod-like member having a handle at a rear end thereof;

a blade attached to a forward end of said rod-like member, said blade presenting a substantially flat face;

said rod-like member having a substantially straight first section extending rearwardly from said blade substantially perpendicularly to said flat face of said blade;

said blade extending downwardly from said first section a distance which is less than the distance between a lower plate of said gutter and a gutter support member extending transversely across an upper inner portion of said gutter;

said first section of said rod-like member being disposed in its entirety in said gutter beneath said transversely-extending gutter support member when said tool is in use with said blade disposed in said gutter;

said rod-like member havng a substantially straight second section extending upwardly from said first section;

said rod-like member further having a substantially straight third section extending rearwardly from said second section with respect to said first section and being positioned a distance above said first section such that said third section is disposed just above said gutter when said tool is in use with said blade disposed in said gutter;

said handle being provided at a rear end of said third section;

said second section being substantially shorter in length than either said first section or said third section;

said second section being of a length approximately equal to one-half the length of said first section; and said first section extending rearwardly of said blade a distance at least approximately twice the horizontal width of said blade.

4. A gutter cleaning tool comprising:

a rod-like member having a handle at a rear end thereof;

a blade attached to a forward end of said rod-like member, said blade presenting a substantially flat face;

said rod-like member having a substantially straight first section extending rearwardly from said blade substantially perpendicularly to said flat face of said blade;

said blade extending downwardly from said first section a distance which is less than the distance between a lower plate of said gutter and a gutter support member extending transversely across an upper inner portion of said gutter;

said first section of said rod-like member being disposed in its entirety in said gutter beneath said transversely-extending gutter support member when said tool is in use with said blade disposed in said gutter;

said rod-like member having a substantially straight second section extending upwardly from said first section;

said rod-like member further having a substantially straight third section extending rearwardly from said second section with respect to said first section and being positioned a distance above said first section such that said third section is disposed just above said gutter when said tool is in use with said blade disposed in said gutter;

said handle being provided at a rear end of said third section;

said second section being substantially shorter in length than either said first section or said third section;

said second section being of a length approximately equal to one-half the length of said first section; and said blade being connected to said first section at a point adjacent the uppermost end of said blade with said blade extending downwardly from said first section.

5. The gutter cleaning tool of claim 4 wherein said blade has the shape of an inverted "T".

* * * * *